US007198455B2

(12) United States Patent
Downham

(10) Patent No.: US 7,198,455 B2
(45) Date of Patent: Apr. 3, 2007

(54) VACUUM PUMPING ARRANGEMENT

(75) Inventor: Stephen Edward Downham, Worthing (GB)

(73) Assignee: The BOC Group plc, Windlesham (GB)

( * ) Notice: Subject to any disclaimer, the term of this patent is extended or adjusted under 35 U.S.C. 154(b) by 162 days.

(21) Appl. No.: 10/991,189

(22) Filed: Nov. 17, 2004

(65) Prior Publication Data

US 2005/0118013 A1 Jun. 2, 2005

(30) Foreign Application Priority Data

Nov. 21, 2003 (GB) ..... 0327149.1

(51) Int. Cl.
*F04D 1/24* (2006.01)
*F04D 29/42* (2006.01)

(52) U.S. Cl. ..... 415/55.2; 415/55.1; 415/55.4

(58) Field of Classification Search ..... 415/55.1, 415/55.2, 55.4, 55.6, 56.5
See application file for complete search history.

(56) References Cited

FOREIGN PATENT DOCUMENTS

EP 0 636 791 A1 2/1995
EP 0 636 792 A1 2/1995
EP 1 363 027 A1 11/2003
GB 2220706 A 1/1990

OTHER PUBLICATIONS

United Kingdom Search Report of Application No. GB 0327149.1; Date of search: Apr. 20, 2004.

*Primary Examiner*—Edward K. Look
*Assistant Examiner*—Dwayne J White
(74) *Attorney, Agent, or Firm*—Ira Lee Zebrak; Mary K. Nicholes

(57) ABSTRACT

In a pumping arrangement for a chamber, a regenerative pumping mechanism comprises a rotor and a stator having an annular channel within which rotor blades rotate to urge fluid along the channel. The channel has a stripper, a channel inlet positioned adjacent one end of the stripper and through which fluid from the chamber enters the channel, and a channel outlet positioned adjacent the other end of the stripper and through which pressurised fluid leaves the channel. The stator further comprises a fluid bypass in the form of a bore having an inlet and an outlet on either side of the stripper. A valve allows fluid entering the channel to selectively diverted through the bore to the channel outlet. This can allow the performance of the pump to be varied without changing the speed of rotation of the rotor, and thus allow the pressure in the chamber to be accurately controlled.

15 Claims, 4 Drawing Sheets

VACUUM PUMPING ARRANGEMENT

FIELD OF THE INVENTION

The present invention relates to a vacuum pumping arrangement.

BACKGROUND OF THE INVENTION

The pressure in a semiconductor processing chamber may be controlled by varying the rate at which process gases are exhausted from the chamber by a vacuum pumping arrangement. Different process gases are used in different respective semiconductor processing methods and for each gas, there is a desired relationship between chamber pressure and flow rate through the chamber. Therefore, for each gas, chamber pressure must be accurately controlled during semiconductor processing.

Various arrangements have been proposed for controlling the pressure in the semiconductor process chamber. In one such arrangement, a throttle valve is provided between the outlet of the semiconductor processing chamber and the inlet of the pumping arrangement. Such throttle valves are relatively large and expensive, and can be the cause of contamination in the chamber resulting in lower yield of semiconductor products. Regular cleaning of the valve is required which is inconvenient since this may require stopping the production process and opening the chamber to clean the system.

It is an object of the present invention to solve these and other problems.

SUMMARY OF THE INVENTION

In a first aspect, the present invention provides a pumping arrangement for controlling pressure in a chamber, the arrangement comprising a regenerative pumping mechanism comprising a rotor; a stator having an annular channel comprising a stripper portion of reduced cross-section, a channel inlet positioned adjacent one end of the stripper and through which fluid from the chamber enters the channel, a channel outlet positioned adjacent the other end of the stripper and through which fluid urged along the channel by rotor rotation leaves the channel, and a fluid bypass to enable fluid to be selectively diverted to the channel outlet without passing along at least part of the channel; the arrangement comprising a control system for controlling the rate of flow of fluid through the bypass and so control the pressure in the chamber.

By providing a bypass to allow fluid entering the stator channel to be selectively diverted through the bypass to the channel outlet, the performance of the pumping arrangement can be varied without changing the speed of rotation of the rotor, and thus allow the pressure in the chamber to be accurately controlled. This can enable pumping performance to be dynamically adjusted in order to meet a current pumping requirement.

The bypass is provided with an inlet proximate the channel inlet and an outlet proximate the channel outlet to enable fluid entering the channel to flow through the bypass to the channel outlet without passing along the remainder of the channel.

In order to maximise the variation in pumping performance the bypass inlet is adjacent one end of the stripper and the bypass outlet is adjacent the other end of the stripper. To facilitate manufacture, the bypass may comprise a bore extending between the channel inlet and the channel outlet.

The control system comprises a variable flow control device, or valve, located within the bypass. The valve may be a two-position on/off valve, which can be used to provide the pumping arrangement with two different operating performances. Alternatively, a variable valve can be used to provide the pumping arrangement with a window of performance, the resolution of the valve influencing the coarseness of the control of pumping performance. For example, the valve may be a butterfly or other control valve having a conductance that can be varied in dependence on, preferably in proportion to, a signal received from a controller.

As mentioned above, a controller is provided for controlling the valve to vary the rate of flow of fluid through the bypass and so control the pressure in the chamber. For example, the control system may comprise a sensor for measuring the pressure in the chamber, and a controller connected to the valve for controlling the conductance of the valve to control the rate of flow of fluid through the bypass.

In a preferred arrangement, the regenerative pumping mechanism is one in which the rotor has a series of blades positioned in an annular array on one side of the rotor for rotation within the annular channel. The mechanism is preferably a multi-stage regenerative pumping mechanism, in which the rotor has at least two series of blades positioned in concentric annular arrays on a side of the rotor and the stator has a corresponding number of channels within which the blades of the arrays can rotate and means are provided to link the channels to form a continuous passageway through which fluid can pass.

The choice of channel with which a bypass is in fluid communication will affect the variability of the pumping performance. In a preferred arrangement, the bypass is in fluid communication with the outermost channel of the fluid passageway, but, alternatively, the bypass may be in fluid communication with one of the other channels. To further improve control of the pumping performance, a bypass may be provided for two or more of the channels. A separate valve may be provided for each bypass or, alternatively, a multi-port spool valve may be provided for controlling the rate of flow of fluid through each bypass.

In another aspect of the present invention, a pumping arrangement is provided comprising a regenerative pumping mechanism comprising a rotor having at least two series of blades positioned in concentric annular arrays on a side of the rotor, and a stator having a corresponding number of annular channels each accommodating a respective series of blades, each channel comprising a stripper portion of reduced cross-section through which the respective series of blades pass during rotor rotation, a channel inlet positioned adjacent one end of the stripper and through which fluid enters the channel, and a channel outlet positioned adjacent the other end of the stripper and through which fluid urged along the channel by rotor rotation leaves the channel, the channels being linked to form a continuous passageway through which fluid can pass, the arrangement further comprising, for at least one of the channels, a fluid bypass to enable fluid within that channel to be selectively diverted to the channel outlet without passing along at least part of that channel, and a control system for controlling the rate of flow of fluid through the bypass.

The present invention also provides a method of controlling pressure in a chamber, the method comprising the steps of connecting to an outlet from the chamber a regenerative pumping mechanism comprising a rotor, a stator having an annular channel, the channel comprising a stripper portion of reduced cross-section, a channel inlet positioned adjacent one end of the stripper and through which fluid from the chamber enters the channel, and a channel outlet positioned adjacent the other end of the stripper and through which fluid urged along the channel by rotor rotation leaves the channel, and a fluid bypass to enable fluid to be selectively diverted to the channel outlet without passing along at least part of the channel, and controlling the rate of flow of fluid through the bypass thereby to control pressure in the chamber.

BRIEF DESCRIPTION OF THE DRAWINGS

The present invention will now be described, by way of example only, with reference to the accompanying drawings, in which:

FIG. 1(*b*) is a cross-sectional view taken along line A—A in FIG. 1(*a*);

FIG. 2(*b*) is a cross-sectional view taken along line A—A in FIG. 2(*a*);

FIG. 1(*a*) illustrates schematically a known single stage radial regenerative fluid pumping mechanism for a pumping arrangement. In this mechanism, a stator 12 is formed with a circular channel 14 that extends between a channel inlet 16 and a channel outlet 18. Located within the channel 14 for rotation therein is an annular array of rotor blades 20 (only a portion of the blades are indicated in FIG. 1 for clarity purposes only). With reference to FIG. 1(*b*), the blades 20 are mounted on a rotatable disc 22 (a portion only of which is shown in FIG. 1(*b*)). Each of the blades is slightly arcuate, with the concave side pointing the direction of rotation of the disc 22.

The channel 14 comprises a stripper channel portion 24 of reduced cross-section in comparison to the remainder of the channel 14, which allows the passage of rotor blades 20 from the outlet 18 to the inlet 16 of the channel 14 whilst urging fluid passing through the channel to be deflected into the outlet 18. With reference to FIG. 1(*b*), the channel 14 has a rounded section along which fluid flows during use in a helical manner, as indicated by arrow 26, and a straight-sided section for receiving the rotor blades 20 extending axially into and travelling along the channel 14.

FIGS. 2(*a*) and 2(*b*) illustrate schematically an embodiment of a single stage radial regenerative fluid pumping mechanism in accordance with an aspect of the present invention. This stage is similar to the prior stage described above with reference to FIGS. 1(*a*) and 1(*b*), with like features being identified with the same reference numbers used in FIGS. 1(*a*) and 1(*b*). In accordance with the present invention, a fluid bypass 100 is provided in the form of a bore formed in the stator 12. The bypass 100 has an inlet on one side (the low pressure side) of the stripper portion 24 adjacent the channel inlet 16 and an outlet on the other side (high pressure side) of the stripper portion 24 adjacent the channel outlet 18. A variable flow control device, or valve, 110 is located within the bypass 100 to control the flow rate of fluid through the bypass 100, and thus control pumping performance. Diverting a greater amount of the fluid through the bypass 100 will decrease pumping performance for a given rotational speed of the rotor blades 20, thereby affecting the ultimate pressure achievable in a chamber being evacuated using the pumping mechanism.

Such a bypass arrangement may also be used in the multi-stage regenerative pumping mechanism. With reference to FIG. 3, a multi-stage radial regenerative fluid pumping mechanism comprises a rotor 200 in the form of a disc mounted on a shaft 202 driven by a motor (not shown) for rotation relative to a stator 204. The rotor 200 comprises a plurality (three shown in FIG. 3, although any number may be provided) of sets of rotor blades 206*a*, 206*b*, 206*c* positioned in concentric annular arrays on one side of the rotor 200 and extending substantially orthogonally therefrom. The stator 202 comprises a similar number of concentric circumferential channels 208*a*, 208*b*, 208*c* formed therein, each channel receiving a respective set of blades. With reference to FIG. 4, ports 210, 212 are provided to link the channels so that, together, the channels form a fluid flow path along which fluid compression takes place. Each channel 208*a*, 208*b*, 208*c* is also provided with a respective stripper portion 220*a*, 220*b*, 220*c*.

Figure 1A:
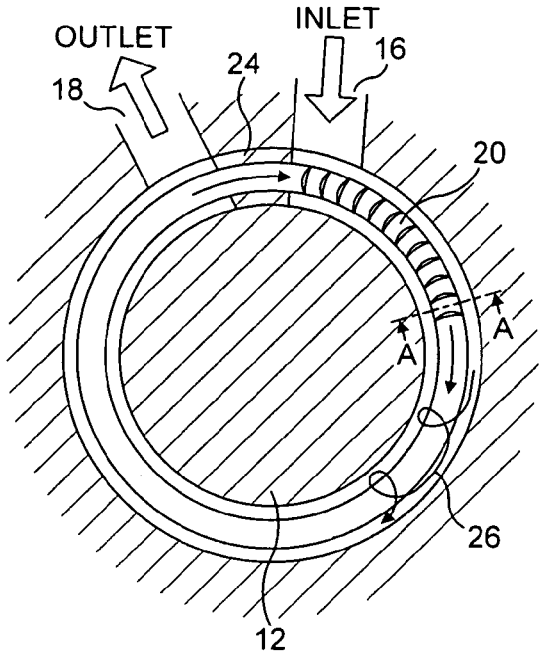
FIG. 1(a) PRIOR ART
FIG. 1(*a*) is a schematic view of a prior single stage radial regenerative pumping mechanism.
Figure 1B:
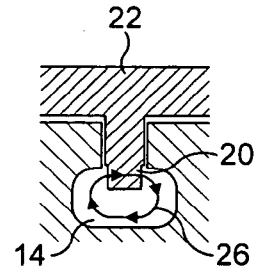
FIG. 1(b) PRIOR ART
Figure 2A:
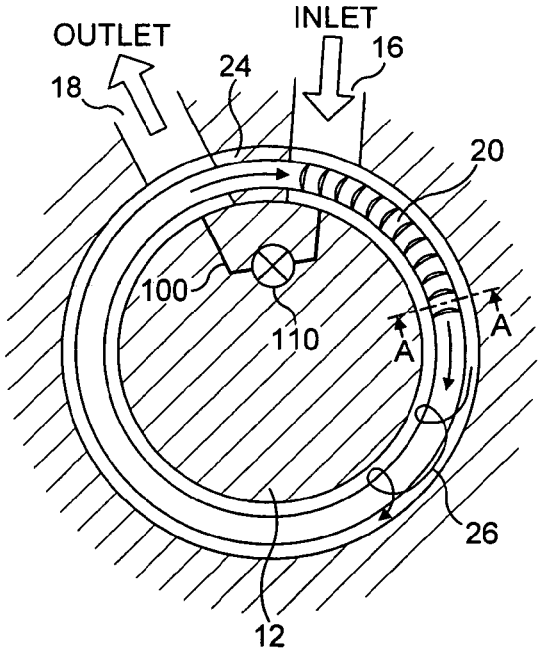
FIG. 2(*a*) is a schematic view of an embodiment of a single stage radial regenerative pumping mechanism according to the present invention.
Figure 2B:
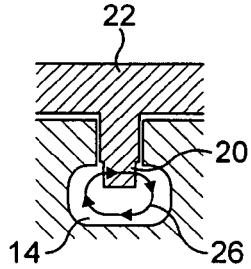
Figure 3:
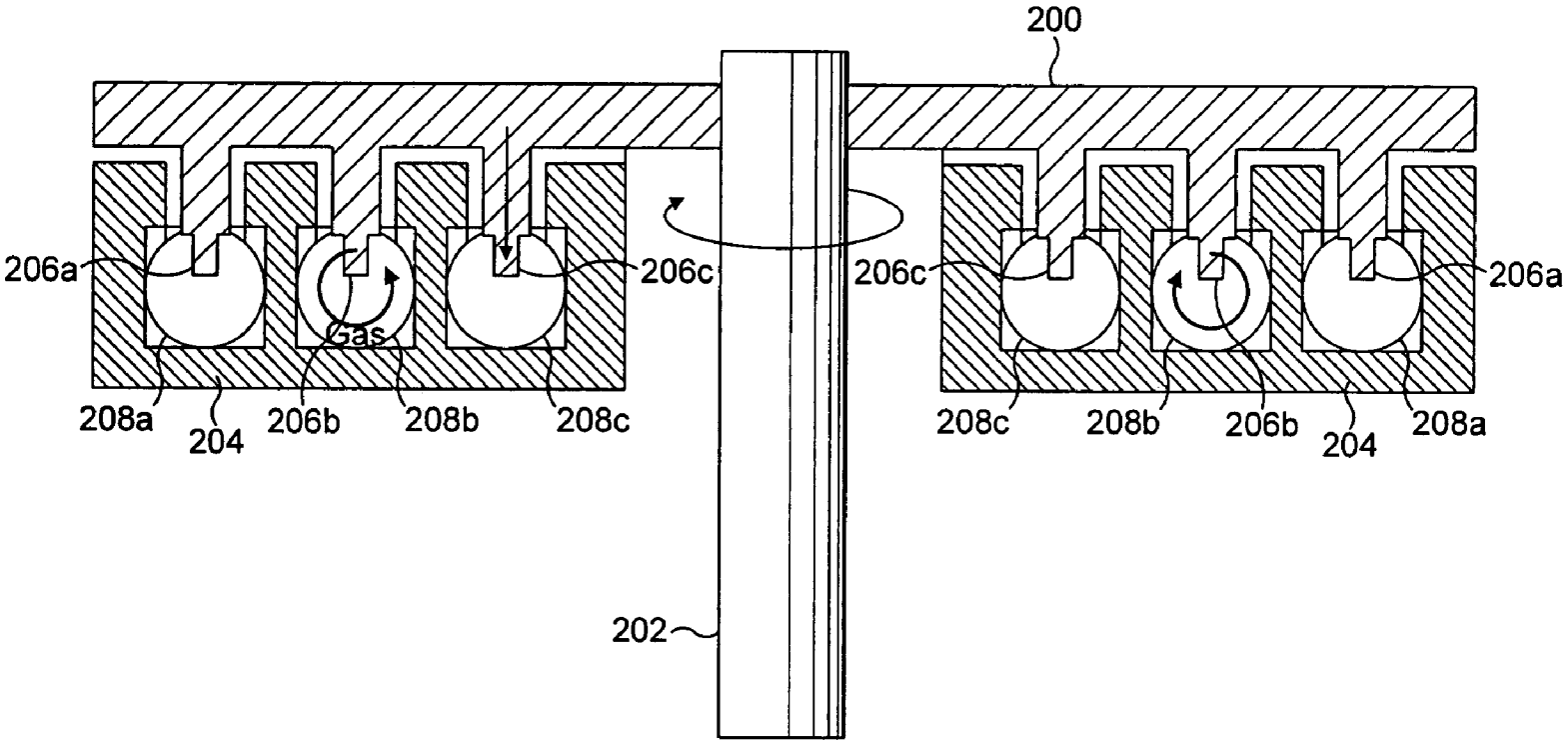
FIG. 3 is a cross-sectional view of a multi-stage radial regenerative pumping mechanism.

In use, with rotation of the shaft 202, fluid, typically gas in a multi-stage mechanism, enters the radially outermost, or first, pumping channel 208*a* from the inlet 214 of the pumping mechanism. The rotor blades 206*a* located within the first pumping channel urge the gas along the channel towards the outlet 216 of the first pumping channel 208*a*. At the outlet 216, compressed gas is diverted by port 210 to the inlet 218 of the middle, or second, pumping channel 208*b*. At this time, rotor blades 206*a* having passed along the first pumping channel 208*a* move through the stripper channel portion 220*a* of the first pumping channel 208*a* and back to the inlet 214. The gas entering the second pumping channel 208*b* is similarly urged along the channel towards the outlet 222 of the second pumping channel 208*b* by the rotor blades 206*b*. At the outlet 222, gas is diverted by port 212 to the inlet 224 of the inner, or third, pumping channel 208*c*, where the gas is similarly urged therealong by the rotor blades to the outlet 226 of the pumping mechanism.

Figure 4:
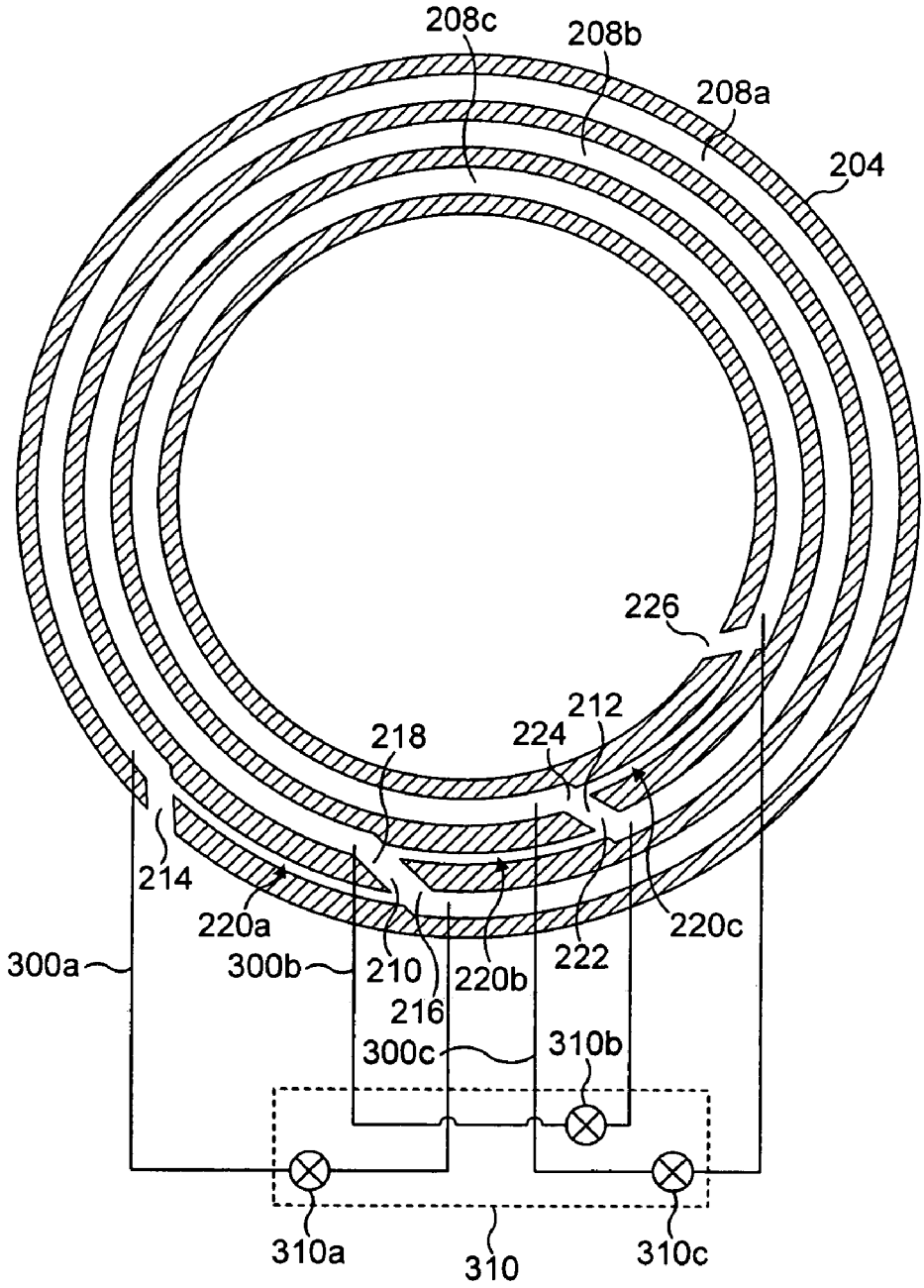
FIG. 4 is a schematic view of the channels of the multi-stage radial regenerative pumping mechanism of FIG. 3.

As shown in FIG. 4, each of the channels 208*a*, 208*b*, 208*c* is provided with a respective gas bypass 300*a*, 300*b*, 300*c* extending between the stripper 220*a*, 220*b*, 220*c* for that channel. Bores formed in the stator 202 may conveniently provide each bypass. An arrangement 310 of valves 310*a*, 310*b*, 310*c* for controlling the rate of flow of gas through the bypasses may comprise, as illustrated, a separate valve for each bypass or, alternatively, a multi-port spool valve for controlling the rate of flow of gas through each bypass.

Figure 5:
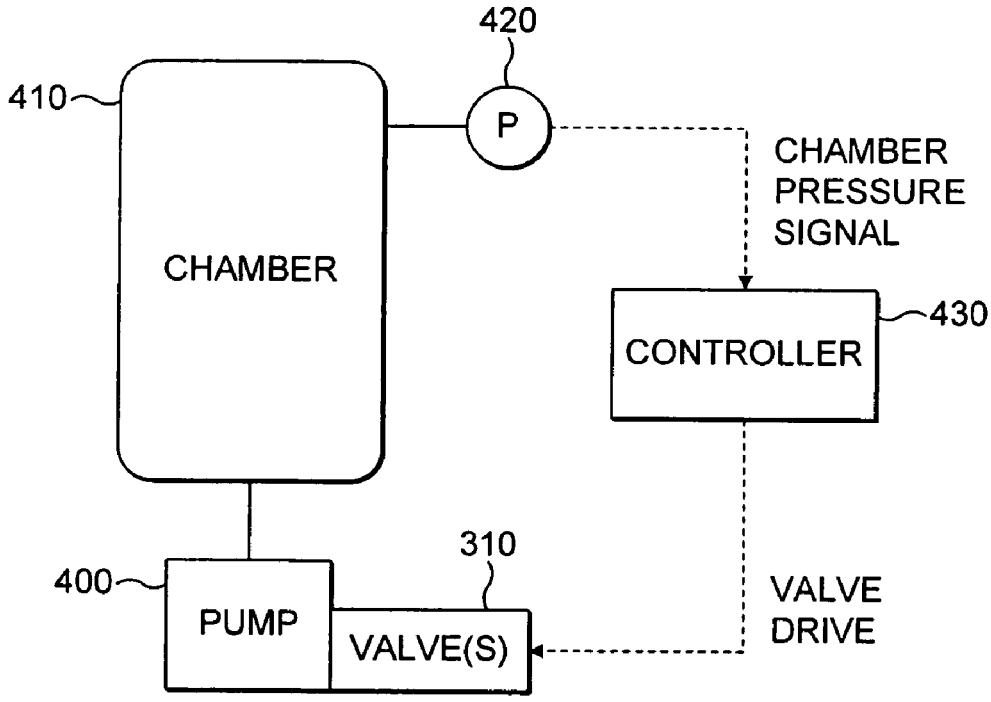
FIG. 5 illustrates a control system for controlling the rate of flow of fluid through the bypasses of FIG. 4.

FIG. 5 illustrates a control system for controlling the valve arrangement 310 of a pump 400 incorporating such a regenerative mechanism. The pressure in the chamber 410 being evacuated by the pump 400 is measured using pressure sensor 420, for example, a Pirani gauge. The sensor 420 outputs a signal indicative of the pressure in the chamber. This signal is fed into a controller 430, which uses the signal to provide a comparison between the current pressure in the chamber 410 and the desired pressure. Depending on the result of the comparison, the controller 430 send as signal to the valve arrangement to vary the conductance of one or more of the valves of the valve arrangement 310 to control the rate of flow of gas through a selected one or more of the bypasses in the regenerative mechanism and thereby adjust the pressure in the chamber 410. For example, where the valve arrangement comprises a spool valve, the controller 430 may be configured to drive an actuator to adjust the position of the spool valve and thus the rate of flow of gas through the bypasses.

In summary, in a pumping arrangement for a chamber, a regenerative pumping mechanism comprises a rotor and a stator having an annular channel within which rotor blades rotate to urge fluid along the channel. The channel has a stripper, a channel inlet positioned adjacent one end of the stripper and through which fluid from the chamber enters the channel, and a channel outlet positioned adjacent the other end of the stripper and through which pressurised fluid leaves the channel. The stator further comprises a fluid bypass in the form of a bore having an inlet and an outlet on either side of the stripper. A valve allows fluid entering the channel to selectively diverted through the bore to the channel outlet. This can allow the performance of the pump to be varied without changing the speed of rotation of the rotor, and thus allow the pressure in the chamber to be accurately controlled.

While the foregoing description and drawings represent the preferred embodiments of the present invention, it will be apparent to those skilled in the art that various changes and modifications may be made therein without departing from the true spirit and scope of the present invention.

The invention claimed is:

1. A pumping arrangement for controlling pressure in a chamber, the arrangement comprising a regenerative pumping mechanism comprising a rotor; a stator having an annular channel comprising a stripper portion of reduced cross-section, a channel inlet positioned adjacent one end of the stripper for fluid to flow from the chamber to the annular channel, a channel outlet positioned adjacent another end of the stripper for fluid urged along the channel by rotor rotation to exit the channel, and a fluid bypass for allowing fluid to be selectively diverted to the channel outlet without passing along at least part of the annular channel; the arrangement further comprising a control system for controlling the rate of flow of fluid through the fluid bypass.

2. The arrangement according to claim 1, wherein the bypass has an inlet proximate the channel inlet and an outlet proximate the channel outlet to enable fluid entering the channel to flow through the bypass to the channel outlet without passing along the remainder of the channel.

3. The arrangement according to claim 1, wherein the bypass inlet is adjacent said one end of the stripper and the bypass outlet is adjacent said another end of the stripper.

4. The arrangement according to claim 1, wherein the bypass comprises a bore extending between the channel inlet and the channel outlet.

5. The arrangement according to claim 1, wherein the control system comprises a variable flow control device located within the bypass.

6. The arrangement according to claim 5, wherein the control system comprises a controller for controlling the variable flow control device to vary the rate of flow of fluid through the bypass and so control the pressure in the chamber.

7. The arrangement according to claim 6, wherein the control system comprises a sensor for measuring the pressure in the chamber, the controller being configured to vary the conductance of the variable flow control device in response to the measured pressure to control the rate of flow of fluid through the bypass.

8. The arrangement according to claim 1, wherein the rotor has a series of blades positioned in an annular array on one side of the rotor for rotation within the annular channel.

9. The arrangement according to claim 1, wherein the rotor has at least two series of blades positioned in concentric annular arrays on a side of the rotor and the stator has a corresponding number of channels within which the blades of the arrays can rotate, the channels being linked to form a continuous passageway through which fluid can pass.

10. The arrangement according to claim 9, wherein the bypass is in fluid communication with the outermost channel of the stator.

11. The arrangement according to claim 10, wherein the control system comprises a variable flow control device located within the bypass.

12. The arrangement according to claim 11, wherein a further bypass is in fluid communication with another channel of the stator, the control system comprising a further variable flow control device for controlling the rate of flow of fluid through the further bypass.

13. A pumping arrangement comprising a regenerative pumping mechanism comprising a rotor having at least two series of blades positioned in concentric annular arrays on a side of the rotor, and a stator having a corresponding number of annular channels each accommodating a respective series of blades, each channel comprising a stripper portion of reduced cross-section through which the respective series of blades pass during rotor rotation, a channel inlet positioned adjacent one end of the stripper and through which fluid enters the channel, and a channel outlet positioned adjacent the other end of the stripper and through which fluid urged along the channel by rotor rotation leaves the channel, the channels being linked to form a continuous passageway through which fluid can pass, the arrangement further comprising, for at least one of the channels, a fluid bypass to enable fluid within that channel to be selectively diverted to the channel outlet without passing along at least part of that channel, and a control system for controlling the rate of flow of fluid through the bypass.

14. The pumping arrangement according to claim 13, wherein the arrangement comprises, for each of the channels, a respective fluid bypass to enable fluid within that channel to be selectively diverted to the channel outlet without passing along at least part of that channel, the control system being configured to control the rate of flow of fluid through each bypass.

15. A method of controlling pressure in a chamber, the method comprising the steps of connecting to an outlet from the chamber a regenerative pumping mechanism comprising a rotor, a stator having an annular channel, a channel comprising a stripper portion of reduced cross-section, a channel inlet positioned adjacent one end of the stripper and through which fluid from the chamber enters the channel, and a channel outlet positioned adjacent the other end of the stripper and through which fluid urged along the channel by rotor rotation leaves the channel, and a fluid bypass to enable fluid to be selectively diverted to the channel outlet without passing along at least part of the channel, and controlling the rate of flow of fluid through the bypass thereby to control pressure in the chamber.

* * * * *